US008405552B2

(12) United States Patent
Bae et al.

(10) Patent No.: US 8,405,552 B2
(45) Date of Patent: Mar. 26, 2013

(54) MULTI-RESONANT BROADBAND ANTENNA

(75) Inventors: Ki-Hyoung Bae, Gumi (KR); Kun-Woo Kim, Gumi (KR); Hyun-Sik Tae, Gumi (KR)

(73) Assignee: Samsung Thales Co., Ltd., Gumi, Kyungsangbuk-Do (KR)

( * ) Notice: Subject to any disclaimer, the term of this patent is extended or adjusted under 35 U.S.C. 154(b) by 896 days.

(21) Appl. No.: 11/826,358

(22) Filed: Jul. 13, 2007

(65) Prior Publication Data

US 2008/0252530 A1 Oct. 16, 2008

(30) Foreign Application Priority Data

Apr. 16, 2007 (KR) ..... 10-2007-0037160
May 30, 2007 (KR) ..... 10-2007-0052929
May 30, 2007 (KR) ..... 10-2007-0052930

(51) Int. Cl.
*H01Q 1/48* (2006.01)

(52) U.S. Cl. ..... 343/700 MS; 343/846

(58) Field of Classification Search ..... 343/700 MS, 343/795, 846

See application file for complete search history.

(56) References Cited

U.S. PATENT DOCUMENTS 6,127,977 A * 10/2000 Cohen ..... 343/700 MS
6,795,021 B2 * 9/2004 Ngai et al. ..... 343/700 MS
7,015,868 B2 3/2006 Puente Baliarde et al.
7,019,695 B2 * 3/2006 Cohen ..... 343/700 MS
7,202,818 B2 * 4/2007 Anguera Pros et al. ..... 343/700 MS
7,511,675 B2 3/2009 Puente-Baliarda et al.
7,583,234 B2 * 9/2009 Iwata et al. ..... 343/795
2006/0208956 A1 * 9/2006 Surducan et al. ..... 343/795
2008/0024366 A1 * 1/2008 Cheng ..... 343/700 MS

FOREIGN PATENT DOCUMENTS

CN 1425208 A 6/2003
CN 1816943 A 8/2006
JP 08056113 2/1996
JP 2004520745 7/2004
JP 2005110123 4/2005
JP 2005303348 10/2005
JP 2006279421 10/2006
WO 02063714 A1 8/2002

OTHER PUBLICATIONS

Jianxin Liang, et al., (2005) "Study of a Printed Circular Disc Monopole Antenna for UWB System" IEEE Transaction Antennas and Propagation 53(11) DOI. 10.1109/TAP.2005.858598.: 3500-3504, cited in the Search Report dated Jun. 1, 2010 for the corresponding Spanish Patent Application No. 200703200.

Seok H. Choi, et al. (2004) "A New Ultra-wideband Antenna for UWB Applications" Microwave and Optical Technology Letters 40(5), cited in the Search Report dated Jun. 1, 2010 for the corresponding Spanish Patent Application No. 200703200.

(Continued)

*Primary Examiner* — Hoang V Nguyen
*Assistant Examiner* — Kyana R McCain
(74) *Attorney, Agent, or Firm* — Robert E. Bushnell, Esq.

(57) ABSTRACT

A multi-resonant broadband antenna constructed with a dielectric substrate; a fractal radiation element having a predetermined fractal grid structure adhered on an upper surface of the dielectric substrate. A feed line adhered on the upper surface of the dielectric substrate feeds the fractal radiation element, and a ground plane positioned on a lower surface of the dielectric substrate opposite to the feed line, is physically separated by the dielectric substrate from the feed line.

15 Claims, 16 Drawing Sheets

OTHER PUBLICATIONS

Werner, D.H., et al. (2003) "An Overview of Fractal Antenna Engineering Research" IEEE Antennas and Propagation 45(1) DOI: 10.1109/MAP.2003.1189650: 38-57, cited in the Search Report dated Jun. 1, 2010 for the corresponding Spanish Patent Application No. 200703200.

Shih-Yuan Chen, et al. (2005) "Broadband Microstrip-fed Modified Quasi-yagi Antenna" IEEE Wireless Communications and Applied Computational Electromagnetics DOI: 10.1109/WCACEM.2005.1469563: 208-211, cited in the Search Report dated Jun. 1, 2010 for the corresponding Spanish Patent Application No. 200703200.

Nessel, J.A., et al. (2005) "Demonstration of a X-band Multilayer Yagi-like Microstrip Patch Antenna With High Directivity and Large Bandwidth" IEEE Antennas and Propagation 1B DOI: 10.1109/APS.2005.1551528.: 227-230, cited in the Search Report dated Jun. 1, 2010 for the corresponding Spanish Patent Application No. 200703200.

The Search Report dated Jun. 1, 2010 for the corresponding Spanish Patent Application No. 200703200 and Request for Entry of the Accompanying Office Action herewith.

Japanese Office Action issued by JPO, dated Mar. 29, 2011, corresponding to Japanese Patent Application No. 2007-320089 together with Request for Entry.

The Chinese Office action issued by Chinese Patent Office on Jul. 13, 2011, corresponding to CN No. 200710306156.2 and its English Translation attached herewith.

Chinese Office action issued by Chinese Patent Office on Mar. 7, 2012 in connection with Chinese Patent Application Serial No. 200710306156.2, which also claims Korean Patent Application Serial Nos. 10-2007-0037160, 10-2007-0052929 and 10-2007-0052930 as its priority documents and Request for Entry attached herewith.

* cited by examiner

MULTI-RESONANT BROADBAND ANTENNA

CLAIM OF PRIORITY

This application makes reference to, incorporates the same herein, and claims all benefits accruing under 35 U.S.C. §119 from applications for MULTI-RESONANT BROADBAND ANTENNA earlier filed in the Korean Intellectual Property Office on the 16 Apr. 2007 and there duly assigned Serial No. 10-2007-0037160, filed on the 30 May 2007 and duly assigned Serial No. 10-2007-0052930, and filed on the 30 May 2007 and duly assigned Serial No. 10-2007-0052929.

BACKGROUND OF THE INVENTION

1. Field of the Invention

The present invention relates to a multi-resonant broadband antenna for use in a multiple frequency band, and more particularly, to a multi-resonant broadband antenna having a fractal structure.

2. Description of the Related Art

Examples of a currently used multi-band antenna include a planar inverted F antenna (PIFA) which has an antenna with a meander line structure or a stack type patch antenna employed as the radiation element. The conventional PIFA could be constituted in an inverted F shape on a antenna ground plane and divided into a feed line and a short-circuit which serves to short-circuit the radiation element of the PIFA from the antenna's ground plane, and shows a resonance characteristic which has a dependence on a distance between the feed line and the short-circuit, and shapes of the feed line and the short-circuit. In order to realize a multi-resonant characteristic in the PIFA, the radiation element above the PIFA is divided into portions having different sizes and then combined. In other words, several antennas having single band characteristics are combined and used. The PIFA may be realized as a small antenna having a multi-band characteristic. If several antennas are combined using a PIFA structure, radiation efficiency and gains of the antennas may be abruptly reduced. Accordingly, the PIFA may not be suitable to be used as a multi-band antenna producing three or more resonances.

When a meander line structure is employed as the antenna's radiating element, the resulting antenna shows similar characteristics to the PIFA. In other words, conventionally, a PIFA, meander line antenna, and several antennas having single band characteristics are often combined in order to realize a small multi-band antenna. If such a small multi-band antenna is realized to show multi-resonant characteristics however, radiation efficiency of the small multi-band antenna abruptly deteriorates. Thus, if the small multi-band antenna is used as a multi-resonant antenna producing three or more resonances, a problem may occur in the performance of the small multi-band antenna.

Also, a multi-resonant antenna using a stack type patch antenna structure includes radiation elements which have different sizes and are arrayed up and down. Accordingly, the size of the multi-resonant antenna is increased. Consequently, the multi-resonant antenna is not suitable to be used as a multi-band antenna producing three or more resonances due to a structural limit, like a PIFA and a meander line antenna as described above.

Contemporary designs for a monopole antenna employing a Hilbert grid structure, can have multi-band frequency characteristics; however, resonance frequency bands will be narrowly formed. Also, if the monopole antenna is made small, the resonance frequency bands become even narrower, and the efficiency of the monopole antenna is lowered. In addition, there are technical limitations impeding the design of monopole antenna, which restrict their suitably for use in a specific frequency band.

SUMMARY OF THE INVENTION

It is an object of the present invention to provide an improved antenna.

It is another object to provide a multi-resonant characteristic in a planar inverted F antenna.

It is still another object to provide a small multi-band antenna producing three or more resonances.

It is yet another object to provide a small multi-band antenna producing three or more resonances with enhanced performance characteristics.

It is still yet another object to provide a small, multi-resonant antenna exhibiting improved return loss across a broad frequency band.

It is a further object to provide an antenna with a fractal grid structure exhibiting multiple frequency bands.

These and other objects may be attained with a micro antenna exhibiting multiple frequency band and broadband characteristics using a fractal radiation element which has a fractal grid structure of a specific pattern.

Embodiments of the principles of the present invention also provide a broadband, high efficiency antenna including a short circuit in which a fractal radiation element and a fractal parasitic radiation element are stacked, and a conducting via is formed between the fractal radiation element and the fractal parasitic radiation element.

According to an aspect of the present invention, there is provided a multi-resonant broadband antenna constructed with a dielectric substrate; a fractal radiation element adhered on an upper surface of the dielectric substrate and having a predetermined fractal grid structure; a feed line adhered on the upper surface of the dielectric substrate and feeding the fractal radiation element; and a antenna ground plane positioned on a lower surface of the dielectric substrate so as to be opposite to the feed line. Consequently, the antenna's ground plane is physically separated by the dielectric substrate from the feed line.

The structures of the fractal pattern which forms the fractal radiation element may be formed as a closed, electrically continuous loop, and maybe formed symmetrically arrayed around the feed line, or alternatively, as an electrically open structure with a proximal terminal of the fractal pattern electrically coupled to the feed line and one, or more, distal terminals of the fractal pattern physically and electrically separated from the feed line and from other portions of the fractal pattern.

Details and improvements of the present invention are disclosed in the details of the following description and in the accompanying dependent claims.

BRIEF DESCRIPTION OF THE DRAWINGS

A more complete appreciation of the invention and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
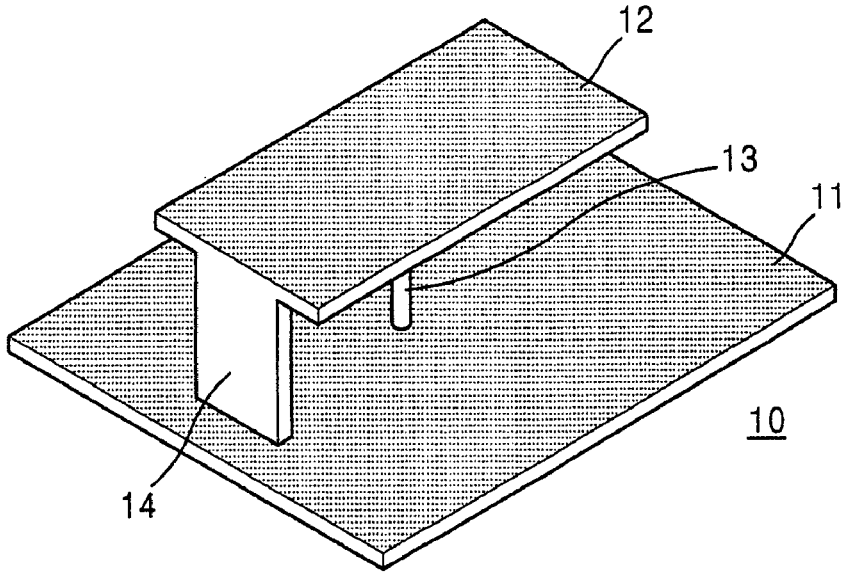
FIG. 1 (PRIOR ART)
FIG. 1 is an oblique view illustrating a structure of a contemporary planar inverted F antenna.
Figure 2:
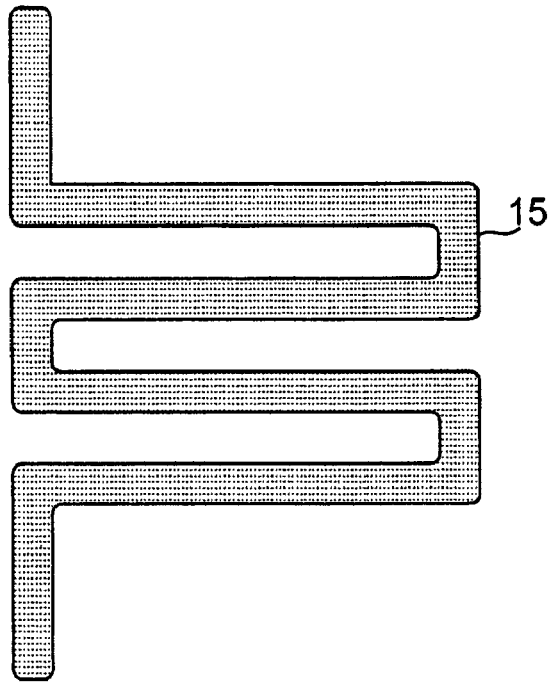
FIG. 2 (PRIOR ART)
FIG. 2 is a plan view illustrating a contemporary meander line structure antenna.

Turning now to the drawings, examples of a currently used multi-band antenna include a planner inverted F antenna (PIFA) illustrated in FIG. 1, an antenna having a meander line structure illustrated in FIG. 2, a stack type patch antenna, etc.

A structure of a contemporary PIFA 10 illustrated by FIG. 1, is constituted in an inverted F shape on ground plane 11 and divided into feed line 13 and short-circuit 14. The short-circuiting part 14 short-circuits radiation element 12 of the PIFA 10 from ground plane 11 and shows a resonance characteristic which has a dependence on a distance of separation between feed line 13 and short-circuit 14 and on the shapes of feed line 13 and short-circuit 14. In order to realize a multi-resonant characteristic in PIFA 10, radiation element 12 above PIFA 10 is divided into portions having different sizes and then combined. In other words, several antennas having single band characteristics are combined and used. PIFA 10 may be realized as a small antenna having a multi-band characteristic. If however, several antennas are combined using a PIFA structure, radiation efficiency and gains of the antennas may be abruptly reduced. Accordingly, PIFA 10 may not be suitable for use as a multi-band antenna producing three or more resonances.

FIG. 2 illustrates an antenna having a meander line structure 15. Here, the antenna shows similar characteristics to PIFA 10 illustrated by FIG. 1.

In other words, in contemporary practice, a PIFA, meander line antenna, and several antennas having single band characteristics are often combined in order to realize a physically small, multi-band antenna. If such a small multi-band antenna is realized to show multi-resonant characteristics however, the radiation efficiency of the small multi-band antenna abruptly deteriorates. Thus, if the small multi-band antenna is constructed as a multi-resonant antenna producing three or more resonances, a problem may occur in a radiation performance of the resulting small multi-band antenna.

Also, a multi-resonant antenna using a stack type patch antenna structure includes radiation elements which have different sizes that are arrayed up and down. Thus, the physical size of the resulting multi-resonant antenna is increased. Also, the multi-resonant antenna is not suitable to be used as a multi-band antenna producing three or more resonances due to a structural limit, like a PIFA and a meander line antenna as described above.

Figure 3:
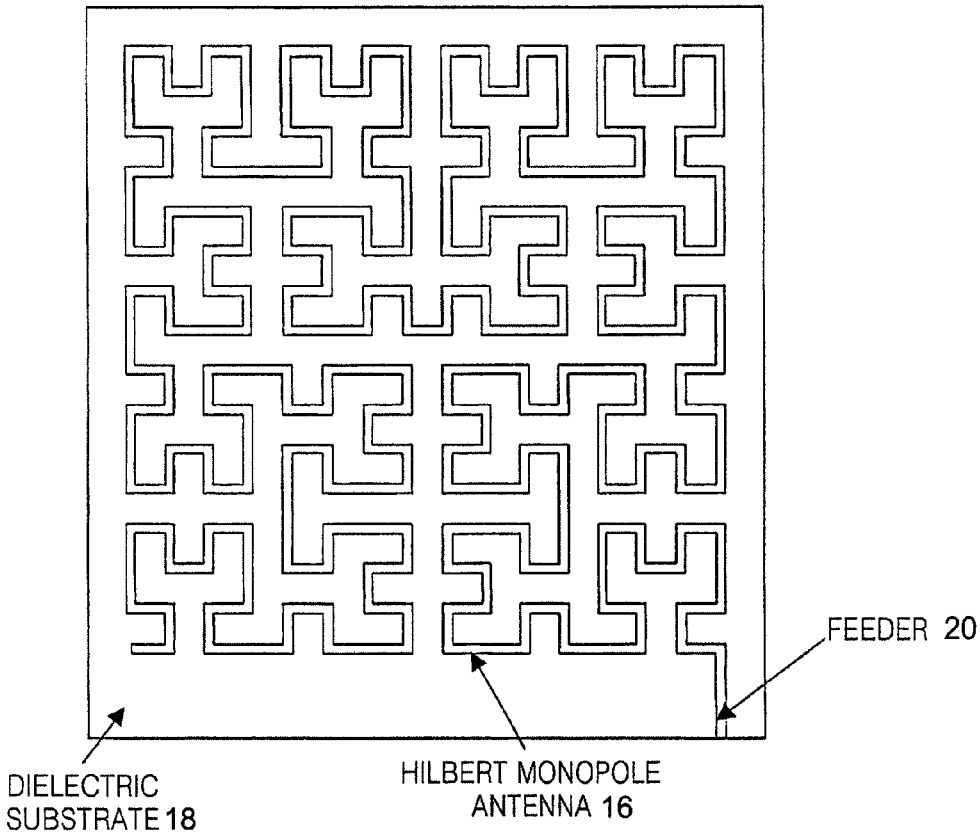
FIG. 3 (PRIOR ART)
FIGS. 3 and 4 are plan and cross-sectional elevation views, respectively, illustrating a contemporary monopole antenna having a Hilbert grid structure.
Figure 4:
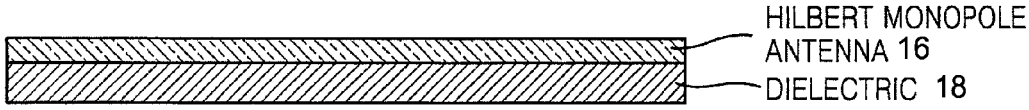
FIG. 4 (PRIOR ART)
Figure 5:
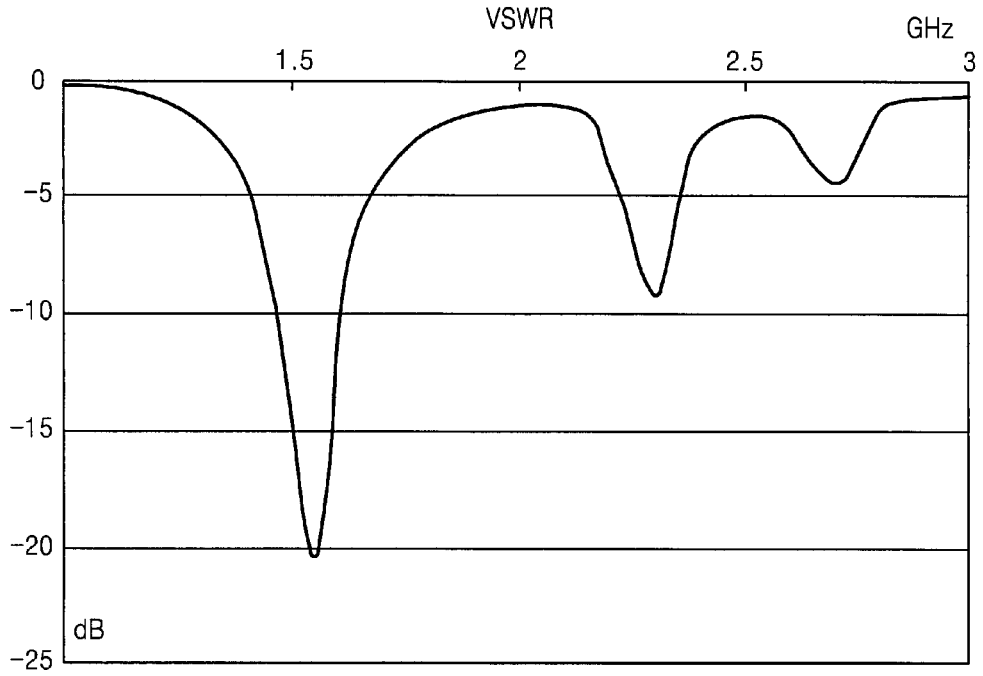
FIG. 5 is a two coordinate graph illustrating variations of the return loss in decibels for the monopole antenna illustrated in FIGS. 3 and 4.

FIGS. 3 and 4 are plan and cross-sectional elevation views illustrating a contemporary monopole antenna using Hilbert grid structure 16 mounted upon a planar surface of dielectric substrate 18 and driven by a signal applied to feed line 20, and FIG. 5 is a graph illustrating the return loss measured in decibels of the monopole antenna illustrated by FIGS. 3 and 4.

Referring to FIGS. 3 and 4, the monopole antenna can have multi-band frequency characteristics. As shown in FIG. 5, the resonance frequency bands are narrowly formed. Also, if the monopole antenna is made small, the resonance frequency bands become concomitantly narrower, and the efficiency of the monopole antenna is lowered. In addition, there is a technical limitation which constricts the design of monopole antennas, and limits their compatibity for use at a specific frequency band.

Preferred embodiments constructed according to the principles of the present invention will now be described in detail with reference to the attached drawings.

Figure 6:
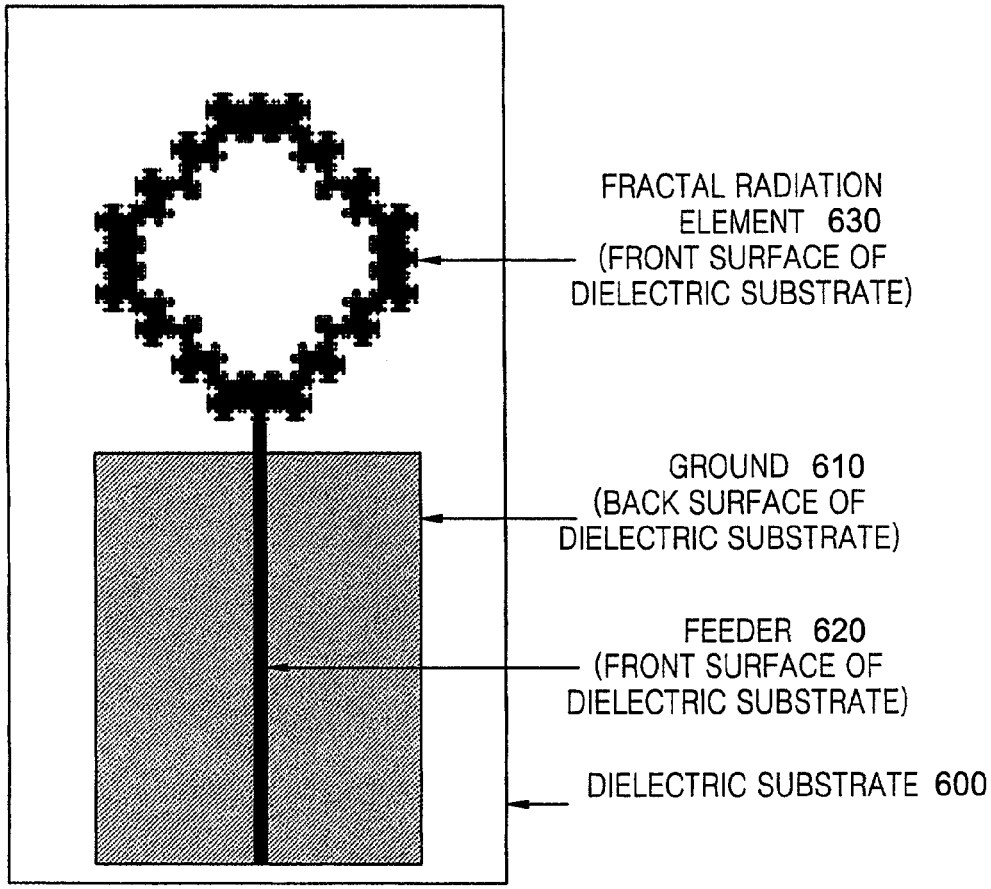
FIG. 6 is a front view of a multi-resonant broadband antenna using a fractal radiation element constructed as one embodiment of the principles of the present invention.
Figure 7:
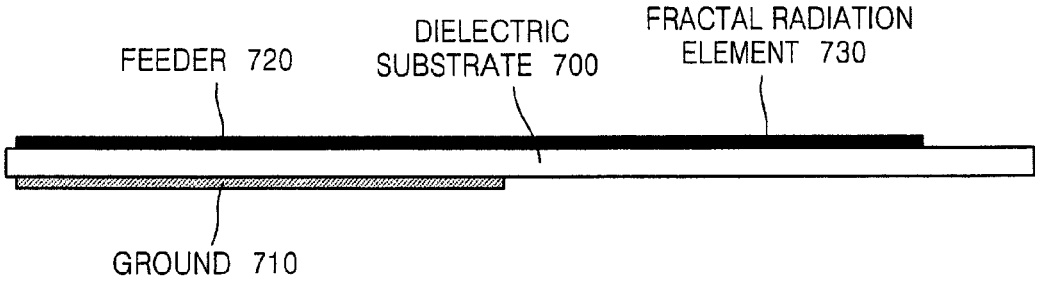
FIG. 7 is a side view of the multi-resonant broadband antenna illustrated by FIG. 6.

FIG. 6 is a front view of a multi-resonant broadband antenna using a fractal radiation element according to an embodiment of the present invention, and FIG. 7 is a side view of the multi-resonant broadband antenna of FIG. 6.

As illustrated in the accompanying drawings, a fractal pattern is a rough or fragmented geometric shape that can be subdivided into parts, each of which is, at least approximately, a reduced size copy of the whole. As a geometric object, a fractal is a self-similar object, at least approximately or stochastically, that has a fine structure at arbitrarily small scales, is too irregular to be easily described in traditional Euclidean geometric language, and that has a simple and recursive definition.

Referring to FIGS. 6 and 7, the multi-resonant broadband antenna according to the present embodiments includes dielectric substrates 600 and 700, antenna ground planes 610 and 710, feed lines 620 and 720, and fractal radiation elements 630 and 730.

The dielectric substrates 600 and 700 are microstrip substrates, e.g., RF4, or highly meander thin films. The dielectric substrates 600 and 700 may be double-sided or single-sided dielectric substrates, preferably, double-sided substrates including highly meander or flexible thin films.

The antenna ground planes 610 and 710 are positioned on back surfaces of the dielectric substrates 600 and 700. The antenna ground planes 610 and 710 are used as ground reference surfaces of the feed lines 620 and 720 for feeding the fractal radiation elements 630 and 730, e.g., reference surfaces for determining impedances of feeding lines.

The feed lines 620 and 720 include feeding lines for feeding power to the fractal radiation elements 630 and 730. The feeding lines are positioned on front surfaces of the dielectric substrates 600 and 700. The antenna ground planes 610 and 710 are positioned on portions of the back surfaces of the dielectric substrates 600 and 700 opposite to the feed lines 620 and 720, and not at portions of the back surfaces above which the fractal radiation elements 630 and 730 are positioned.

The fractal radiation elements 630 and 730 have octagonal shapes in which cross-shaped fractal grid structures are arrayed. Here, a fractal structure means a structure in which a small structure having a predetermined shape is repeated over the entire structure. In other words, the fractal structure is a geometric structure having self-similarity and recursiveness indicating that a fraction and a whole have the same shape.

Entire sizes of the fractal radiation elements 630 and 730 maybe 40×40 mm or less. The antenna ground planes 610 and 710 adhered on the back surfaces of the dielectric substrates 600 and 700 form outer faces which are formed of conductors in communication equipment in which a radiation element is installed, e.g., a portable telephone, a communication terminal, etc. Here, the fractal radiation elements 630 and 730 may include herringbone shapes, lightning shapes, Hilbert fractal grid shapes, and inverted V shapes, besides the cross shapes illustrated in FIG. 6.

A radiation element in which fractal grid shapes having cross shapes, herringbone shapes, lightning shapes, or inverted V shapes are dimensionally fractionized and then arrayed may be used to realize an antenna having multiple frequency band and broadband characteristics. The fractal grid shapes and the array structures may be modified to improve radiation efficiency and broadband characteristics of the multi-resonant broadband antenna.

A modified structure not a general fractal structure is used to expand a length of a line of the multi-resonant broadband antenna per unit area so as to make the multi-resonant broadband antenna small. Also, the modified structure is used to maximize the radiation efficiency of the multi-resonant broadband antenna occurring when the multi-resonant broadband antenna is made small with respect to a corresponding wavelength.

Figure 8:
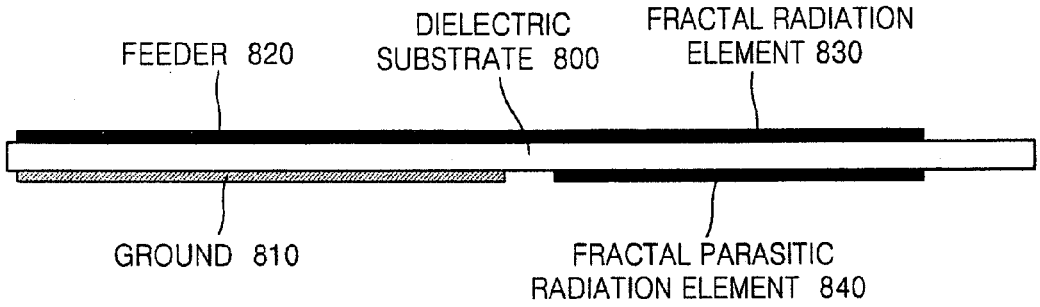
FIG. 8 is a side view of a multi-resonant broadband antenna using a fractal radiation element and a fractal parasitic radiation element as another embodiment of the principles of the present invention.

FIG. 8 is a side view of a multi-resonant broadband antenna using a fractal radiation element and a fractal parasitic radiation element according to another embodiment of the present invention. Referring to FIG. 8, the multi-resonant broadband antenna includes a dielectric substrate 800, an antenna ground plane 810, a feed line 820, a fractal radiation element 830, and a fractal parasitic radiation element 840. The multi-resonant broadband antenna of the present embodiment is different from that of FIG. 7 in that the fractal parasitic radiation element 840 is positioned on a back surface of the dielectric substrate 800 opposite to the fractal radiation element 830.

The fractal radiation element 830 and the fractal parasitic radiation element 840 maintain individual characteristics and independently exist. The fractal parasitic radiation element 840 is positioned on the back surface of the dielectric substrate 800 on which the antenna ground plane 810 is positioned. Thus, electric waves initially radiated from the fractal radiation element 830 are re-radiated by the fractal parasitic radiation element 840. In other words, if a gap between the fractal radiation element 830 and the fractal parasitic radiation element 840 is narrow, the electric waves can be re-radiated by the fractal parasitic radiation element 840, and a length of a line can extend due to coupling between the fractal radiation element 830 and the fractal parasitic radiation element 840. The extension of the length of the line can contribute to improving a performance of the multi-resonant broadband antenna in a low frequency band, return loss, and gain, and making the multi-resonant broadband antenna small.

The fractal radiation element 830 and the fractal parasitic radiation element 840 may have the same fractal structure or different fractal structures. For example, the fractal radiation element 830 may have a cross-shaped fractal structure, and the fractal parasitic radiation element 840 may have a herringbone-shaped fractal structure.

Figure 9:
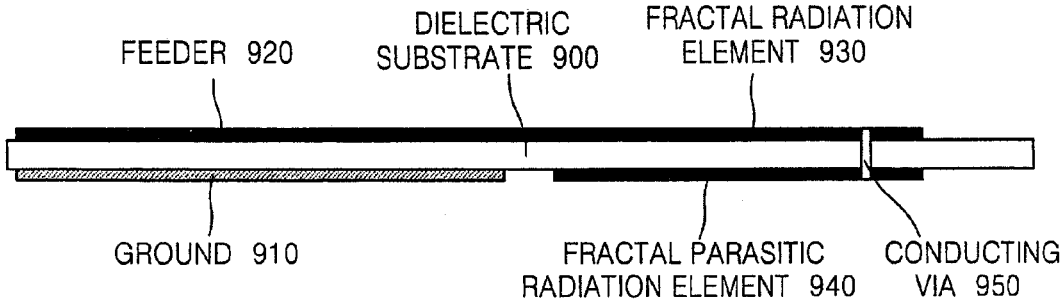
FIG. 9 is a side view of a multi-resonant broadband antenna using a fractal radiation element, a fractal parasitic radiation element, and a short circuit as another embodiment of the principles of the present invention.

FIG. 9 is a side view of a multi-resonant broadband antenna using a fractal radiation element, a fractal parasitic radiation element, and a short circuit according to another embodiment of the present invention. Referring to FIG. 9, the multi-resonant broadband antenna of the present embodiment includes a dielectric substrate 900, an antenna ground plane 910, a feed line 920, a fractal radiation element 930, a fractal parasitic radiation element 940, and a conducting via 950. The multi-resonant broadband antenna of the present embodiment is different from that of FIG. 8 in that the fractal radiation element 930 and the fractal parasitic radiation element 940 are connected to each other through the conducting via 950.

In the multi-resonant broadband antenna of FIG. 9, the fractal radiation element 930 and the fractal parasitic radiation element 940 are connected to each other through the conducting via 950 so as to constitute a short circuit. If the fractal radiation element 930 and the fractal parasitic radiation element 940 are connected to each other to constitute the short circuit, an effective radiation area of the multi-resonant broadband antenna can be increased in a narrow antenna. Also, as the fractal parasitic radiation element 940 is installed on a back surface of the dielectric substrate 900 on which the antenna ground plane 910 is positioned, an entire size of the multi-resonant broadband antenna can be prevented from being increased due to the fractal parasitic radiation element 940.

The conducting via 950 connects the fractal radiation element 930 to the fractal parasitic radiation element 940. Also, the performance of the multi-resonant broadband antenna varies depending on a position of the conducting via 950. Accordingly, the conducting via 950 may be formed in a position distant from the feed line 920, i.e., at an outer portion or in a center of the multi-resonant broadband antenna, to increase an effective radiation area and realize a small multi-resonant broadband antenna. Alternatively, the conducting via 950 may be positioned in both an outer portion and the center of the multi-resonant broadband antenna.

Figure 10:
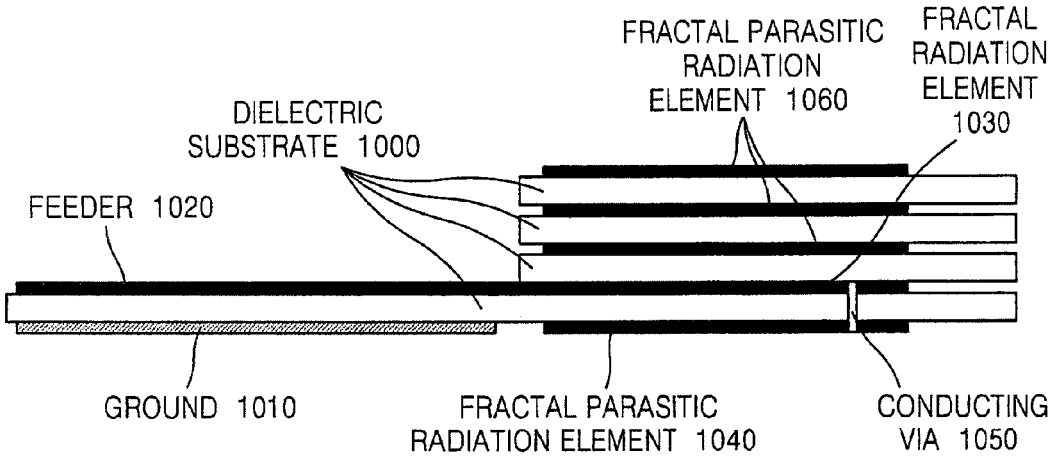
FIG. 10 is a side view of a multi-resonant broadband antenna as another embodiment of the principles of the present invention.

FIG. 10 is a side view of a multi-resonant broadband antenna according to another embodiment of the present invention. Referring to FIG. 10, the multi-resonant broadband antenna includes dielectric substrates 1000, a antenna ground plane 1010, a feed line 1020, a fractal radiation element 1030, a fractal parasitic radiation element 1040, and a conducting via 1050. The dielectric substrates 1000 and fractal parasitic radiation elements 1060 are sequentially stacked on the fractal radiation element 1030. Thus, the fractal parasitic radiation elements 1040 and 1060 having the same or different multi-resonance characteristics as or from that of the fractal radiation element 1030 are stacked. As a result, the multi-resonance characteristics of the fractal radiation element 1030 and the fractal parasitic radiation elements 1040 and 1060 can be combined into one to obtain a broadband characteristic.

Figure 11:
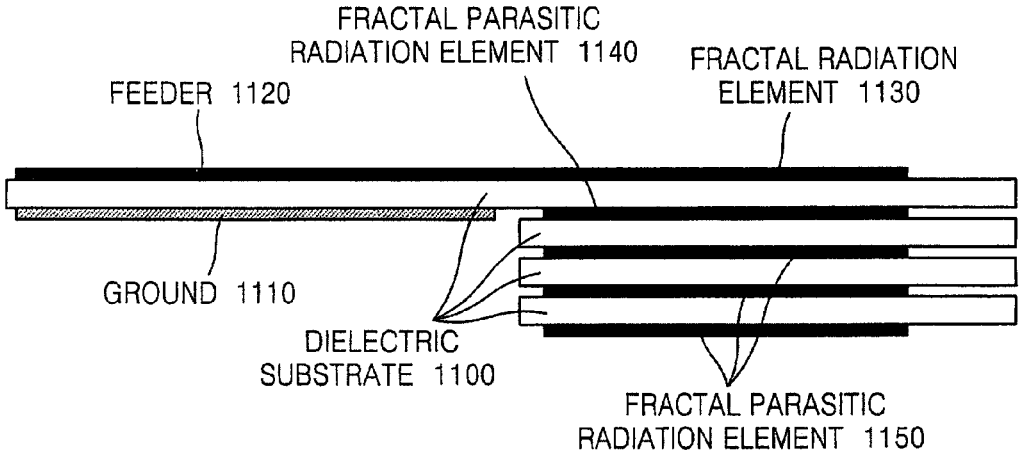
FIG. 11 is a side view of a multi-resonant broadband antenna as another embodiment of the principles of the present invention.

FIG. 11 is a side view of a multi-resonant broadband antenna according to another embodiment of the present invention. Referring to FIG. 11, the multi-resonant broadband antenna includes dielectric substrates 1100, a antenna ground plane 1110, a feed line 1120, a fractal radiation element 1130, and fractal parasitic radiation elements 1140 and 1150. The dielectric substrates 1100 and the fractal parasitic radiation elements 1150 are sequentially stacked on the fractal parasitic radiation element 1140. Thus, the fractal parasitic radiation elements 1140 and 1150 having the same or different multi-resonance characteristics as or from that of the fractal radiation element 1130 can be stacked. As a result, the multi-resonance characteristics of the fractal radiation element 1130 and the fractal parasitic radiation elements 1140 and 1150 can be combined into one to obtain broadband characteristics.

Figure 12:
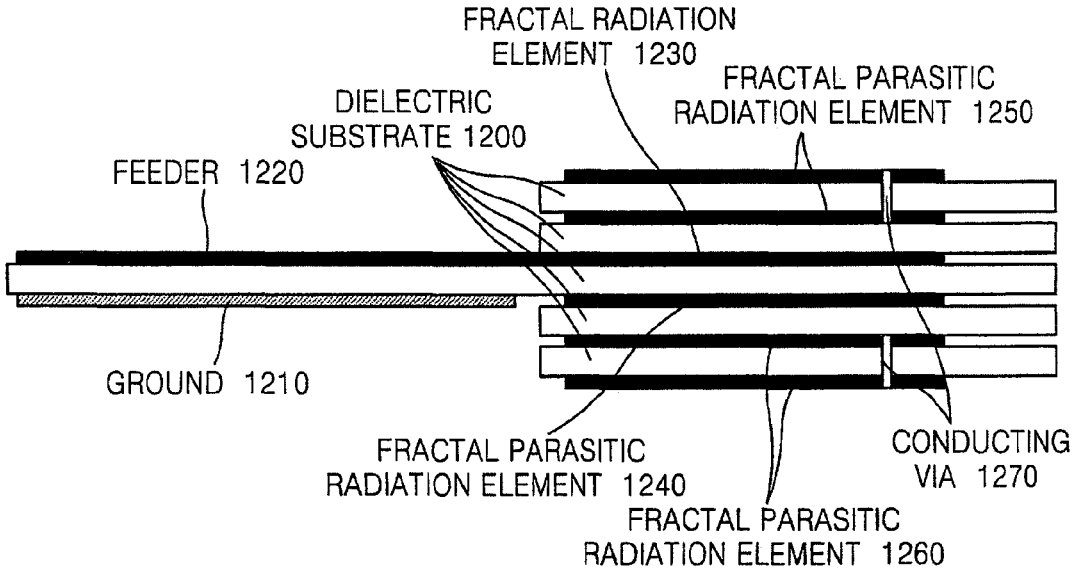
FIG. 12 is a side view of a multi-resonant broadband antenna as another embodiment of the principles of the present invention.

FIG. 12 is a side view of a multi-resonant broadband antenna according to another embodiment of the present invention.

Referring to FIG. 12, the multi-resonant broadband antenna includes dielectric substrates 1200, a antenna ground plane 1210, a feed line 1220, a fractal radiation element 1230, fractal parasitic radiation elements 1240, 1250, and 1260, and conducting vias 1270. The dielectric substrates 1200 and the fractal parasitic radiation elements 1250 are sequentially stacked on the fractal radiation element 1230. Also, the dielectric substrates 1200 and the fractal parasitic radiation elements 1260 are sequentially stacked underneath the fractal parasitic radiation element 1240. Thus, the fractal parasitic radiation elements 1240, 1250, and 1260 having the same or different multi-resonance characteristics as or from that of the fractal radiation element 1230 can be stacked. As a result, the multi-resonance characteristics of the fractal radiation element 1230 and the fractal parasitic radiation elements 1240, 1250, and 1260 can be combined into one to obtain broadband characteristics.

As illustrated in FIGS. 10 through 12, fractal parasitic radiation elements maybe formed on a double-sided dielectric substrate and have the same shape or different shapes. Also, the fractal parasitic radiation elements may have asymmetric structures in which the fractal parasitic radiation elements are stacked only on or underneath the double-sided substrate or symmetric structures in which the fractal parasitic radiation elements are stacked on and underneath the double-sided substrate. Alternatively, the fractal parasitic radiation elements may have asymmetric structures in which the fractal parasitic radiation elements are stacked on the double-sided substrate. However, the number of fractal parasitic radiation elements stacked on the double-sided substrate maybe different from the number of fractal parasitic radiation elements stacked underneath the double-sided substrate. Alternatively, the fractal parasitic radiation elements may be stacked using or without conducting vias so as to realize a stack type antenna.

As described above, a fractal radiation element and a fractal parasitic radiation element can be stacked in one or more layer on, underneath, or on both sides of a double-sided substrate. Thus, electric waves radiated from the fractal radiation element and the fractal parasitic radiation element can be re-radiated, an effective radiation area can be increased in a narrow antenna due to coupling between the fraction radiation element and the fractal parasitic radiation element. The increase in the effective radiation area can contribute to improving a performance, return loss, and gain of the multi-resonant broadband antenna in a low frequency band and to making the multi-resonant broadband antenna small.

Figure 13:
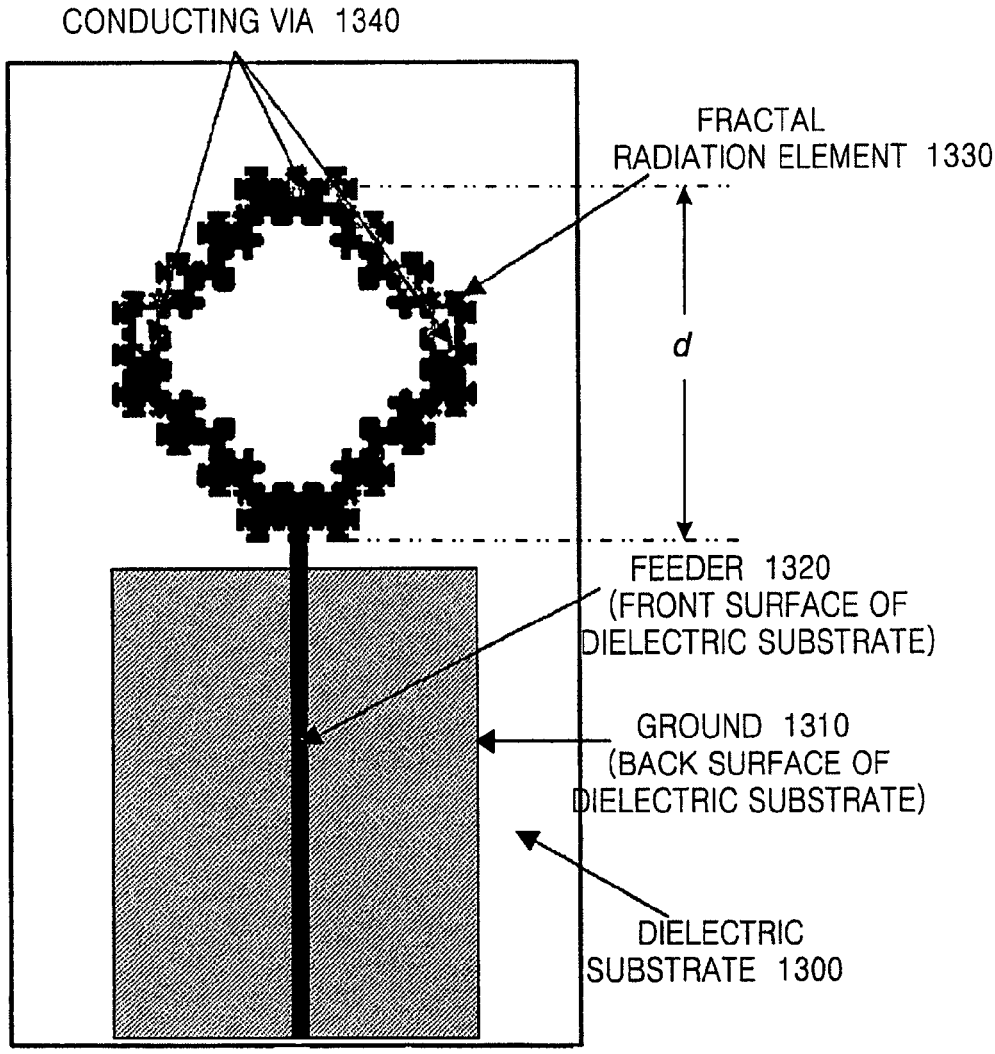
FIG. 13 is a front view of a multi-resonant broadband antenna as another embodiment of the principles of the present invention.

FIG. 13 is a front view of a multi-resonant broadband antenna according to another embodiment of the present invention. Referring to FIG. 13, the multi-resonant broadband antenna includes a dielectric substrate, a antenna ground plane 1310, a feed line 1320, a fractal radiation element 1330, and three conducting vias 1340. Although now shown in FIG. 13, a fractal parasitic radiation element is positioned on a back surface of the dielectric substrate 1300 and is connected to the fractal radiation element 1330 through the three conducting vias 1340.

Here, the fractal radiation element 1330 has a cross-shaped fractal grid structure in which octagonal shapes are arrayed. An entire size of the fractal radiation element 1330 may be within a range of 40×40 mm. The fractal parasitic radiation element opposite to the fractal radiation element 1330 positioned on the back surface of the dielectric substrate 1300 may have a cross-shaped fractal grid structure or a different shape fractal grid structure. The three conducting vias 1340 are positioned in an upper portion and both sides of the cross-shaped fractal grid structure in which the octagonal shapes are arrayed. The three conducting vias 1340 may be positioned as far as possible from the feed line 1320 so as to extend an effective radiation area of the multi-resonant broadband antenna and realize a multi-resonant broadband antenna.

Conducting vias 1340 are positioned at a center and diametrically opposite corners of an upper portion of the fractal radiation element 1330, along the outer portion of the ring-shaped fractal pattern forming radiation element 1330, essentially at the periphery of the fractal pattern of fractal radiation element 1330, longitudinally opposite from feed line 1360. Conducting vias 1340 are effectively separated from feed line 1360 as far as possible; that is, conducting vias 1340 are separated from feed line 2160 by an approximation of the width "d" of fractal pattern 1330.

FIGS. 14 through 26 illustrate different fractal structures that are suitable for use as fractal radiating elements and as fractal parasitic radiating elements in the practice of the principles of the present invention.

Figure 14:
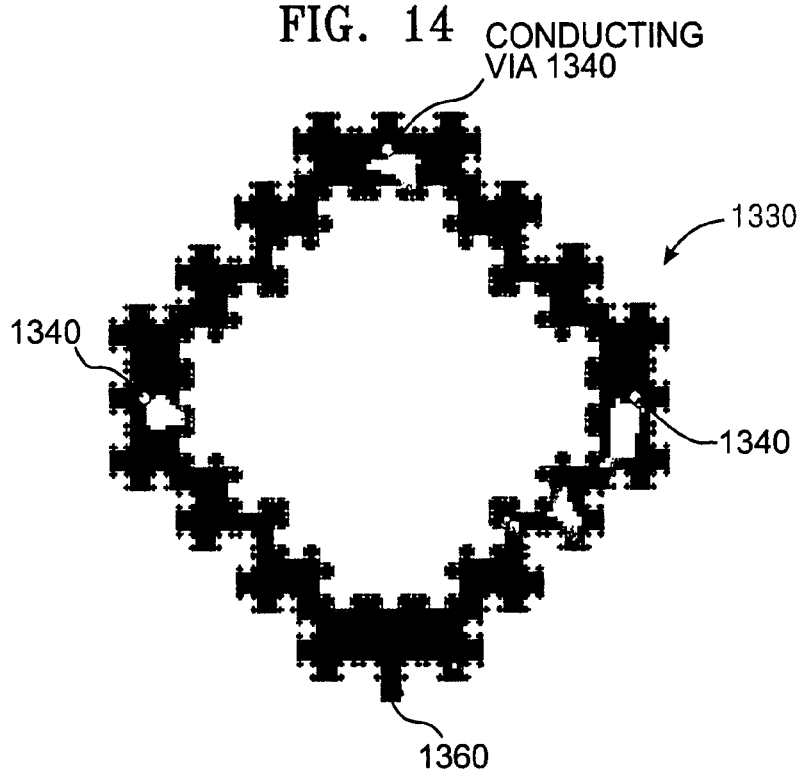
FIGS. 14 through 26 illustrate patterns for fractal structures constructed as elements for use in various embodiments according to the principles of the present invention.

FIG. 14 illustrates a detailed structure of the fractal radiation element 1330 of FIG. 13. Positions of at least three of the conducting vias 1340 are more clearly illustrated in FIG. 14. Conducting vias 1340 are positioned at a center and diametrically opposite corners of an upper portion of the fractal radiation element 1330, along the outermost ring at the periphery of the fractal pattern of fractal radiation element 1330, longitudinally opposite from feed line 1360. Conducting vias 1340 are effectively separated from feed line 1360 as far as possible; that is, conducting vias 1340 are separated from feed line 2160 by an approximation of the width of fractal pattern 1330. Feed line 1360 is electrically coupled to drive fractional radiation element 1330.

A resonance characteristic has a dependence on a distance between feed line 1360 and conducting vias 1340 and shapes of feed line 1360 and conducting vias 1340.

Multi-resonant broadband antennas of FIGS. 15 through 22 include dielectric substrates, antenna ground planes, feed lines, and fractal radiation elements. The multi-resonant broadband antennas may further include at least one or more fractal parasitic radiation elements and conducting vias. Feed line 1560 is electrically coupled to drive each of fractional radiation elements 1510, 1520 and 1530. Except for stack positions and stack numbers of the fractal radiation elements or the fractal parasitic radiation elements and positions of the conducting vias, functions and operations of other elements are the same as those of FIG. 13, and thus their detailed descriptions do not need to be repeated in the following paragraphs.

Figure 15:
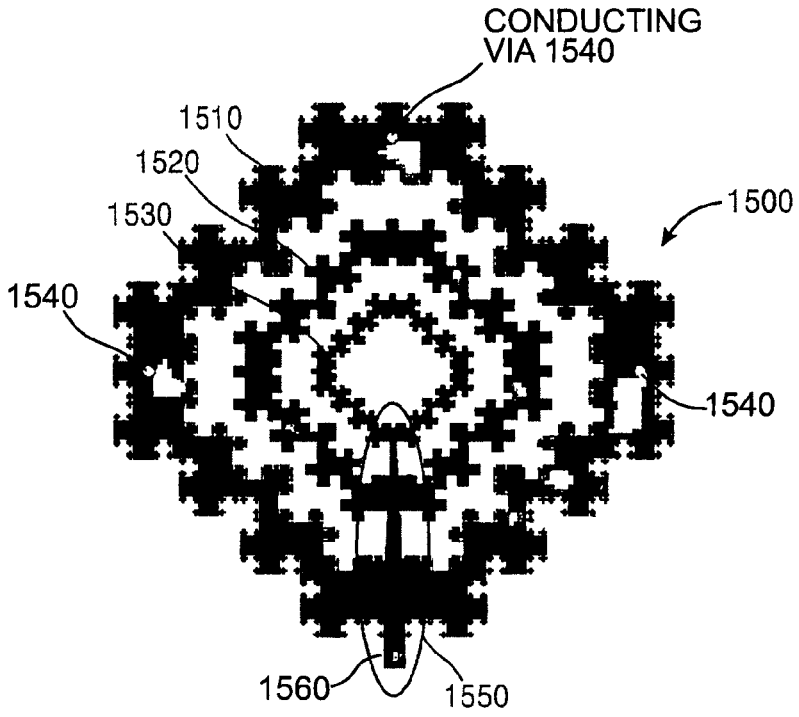

A fractal radiation element 1500 of FIG. 15 has a triple fractal structure. In the triple fractal structure, a first, or outermost, fractal radiation element 1510 has the same shape as the fractal radiation element 1330 of FIG. 14. Also, a second, or intermediate, fractal radiation element 1520, which is smaller than the first fractal radiation element 1510 but has the same shape as the first fractal radiation element 1510, is disposed inside the first fractal radiation element 1510. A third, or inner most, radiation element 1530, which is characterized by a smaller cross-sectional dimension (such as a diameter) than the second fractal radiation element 1520, but has the same shape as the second fractal radiation element 1520, is disposed inside the second fractal radiation element 1520. In other words, the fractal radiation element 1500 of FIG. 15 has a structure in which the fractal radiation element 1330 of FIG. 14 are fractionized in several units and then coaxially arrayed. Alternatively, fractal radiation element 1500 may have a double or quadruplex structure rather than the triple structure as illustrated in FIG. 15. The first, second, and third fractal radiation elements 1510, 1520, and 1530 constituting the triple structure is operationally connected to a feed line 1550. Positions of conducting vias 1540 are the same as those of the conducting vias 1340 of FIG. 14.

Figure 16:
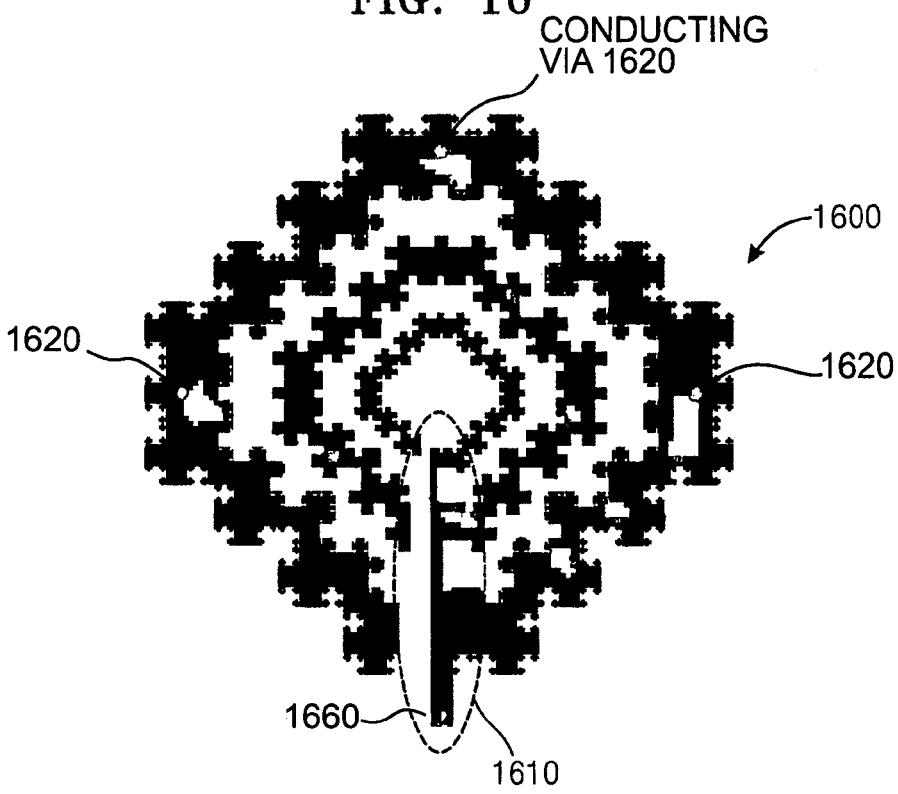

A fractal radiation element of FIG. 16 is a modification of the fractal radiation element 1500 of FIG. 15. Feed line 1760 is electrically coupled to drive each of fractional radiation elements forming fractal radiating element 1700. Although each of the fractal rings forming fractal radiation element 1500 of FIG. 15 form a completely closed loop coupled to feed line 1560, in the embodiment illustrated by FIG. 16, fractal radiation element 1600 of the present embodiment is opened along one side of feed line 1610. Although described in the embodiment of FIG. 16 illustrates the fractal element electrically opened along one side of feed line 1610, a circular, rectangular or polygonal fractal pattern may be electrically opened at other positions along the single or multiple rings forming the fractal pattern for a fractal radiating element, or a fractal parasitic radiating element.

Figure 17:
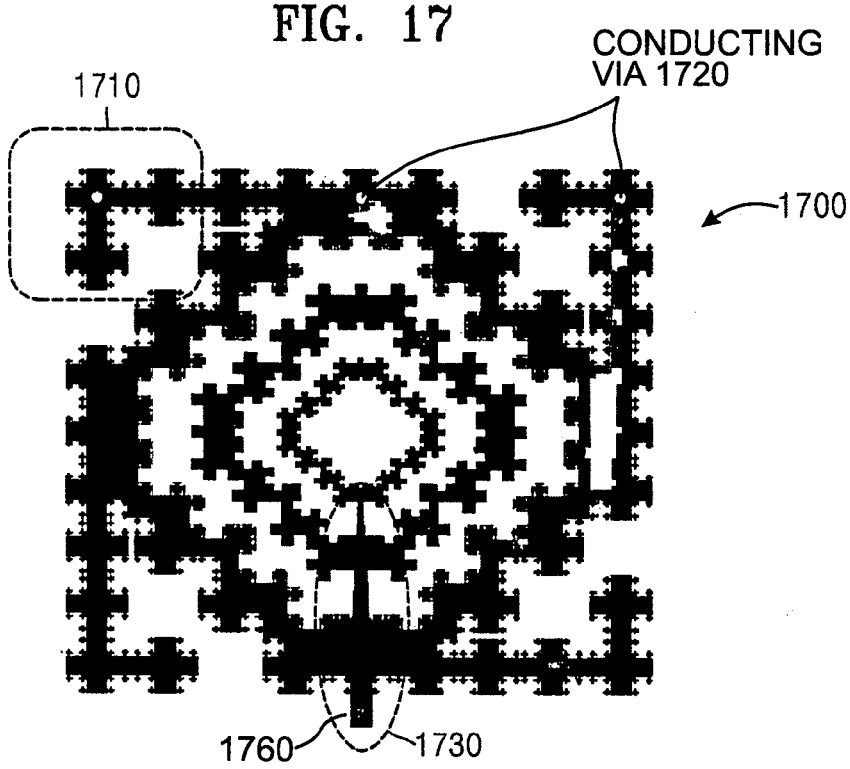

A fractal radiation element 1700 of FIG. 17 is a modification of the fractal radiation element 1500 of FIG. 15. Asymmetrical "L"-shaped fractal grid structures, that is "L"-shaped fractal grid structures with legs of unequal length, are added to each of the four corners of the fractal radiation element 1500 of FIG. 15, in order to form fractal radiation element 1700 illustrated by FIG. 17. The asymmetrical "L"-shaped fractal grid structures 1710 do not form electrically closed loops. Differently from conducting vias 1540 of FIG. 15 and conducting vias 1620 of FIG. 16, conducting vias 1720 are positioned in corners of the "L"-shaped fractal grid structures 1710 which tangentially coupled to the outer periphery of the outmost, or first, of the plurality of coaxially aligned, physically separate rings of the fractal pattern forming fractal radiating element 1700. Thus, electrical conducting vias 1720 may be spaced even more distant from feed line 1730.

Figure 18:
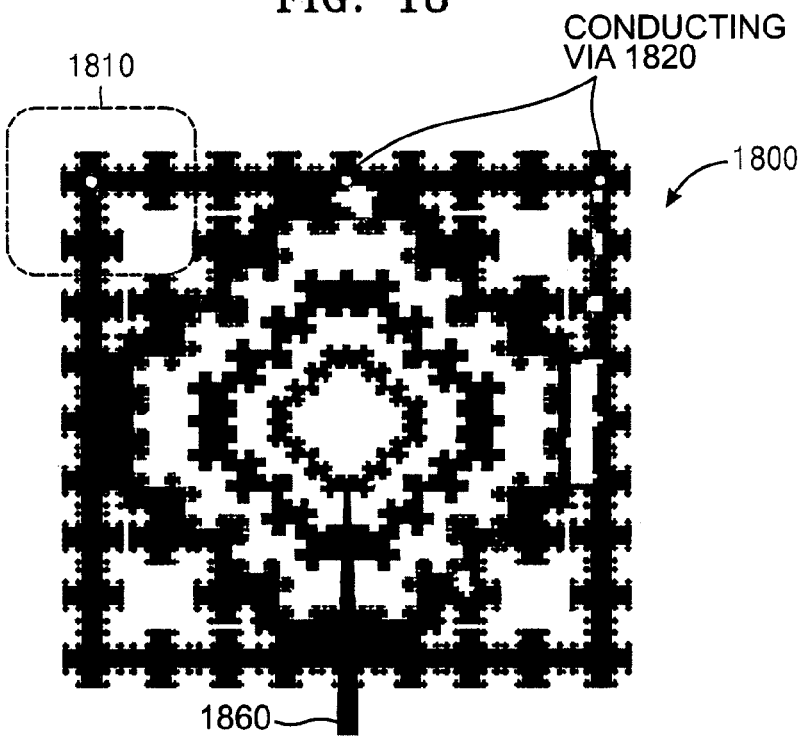

Symmetrical "L"-shaped fractal grid structures, that is "L"-shaped fractal grid structures with legs of equal length, are added to a fractal structure as the fractal radiation element 1700 of FIG. 17 to form completely closed loops 1810 so as to constitute a fractal radiation element 1800 of FIG. 18. Conducting vias 1820 are positioned at a center and at the corners of an upper portion of the outermost ring augmented by the symmetrical "L"-shaped grid structures forming fractal radiation element 1800 as in FIG. 17.

Figure 19:
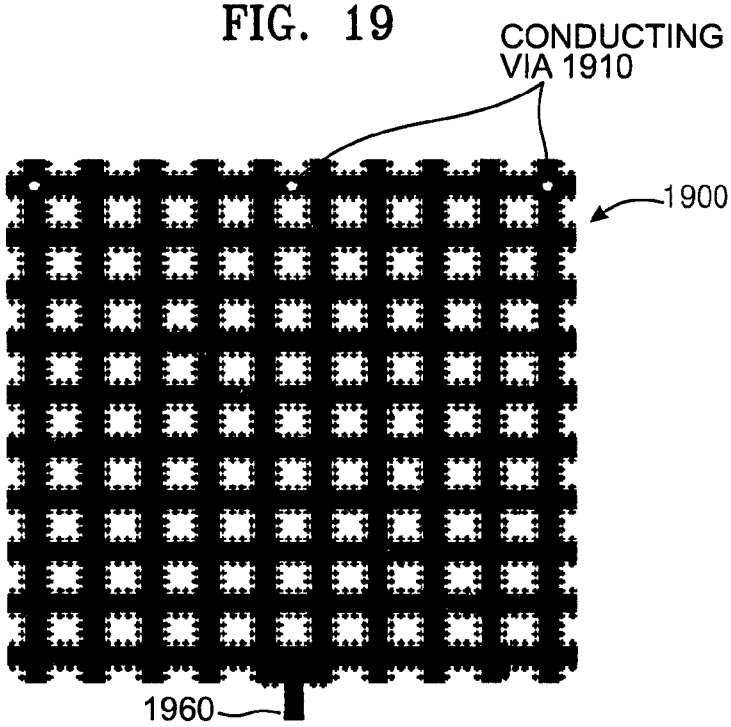

A fractal radiation element 1900 of FIG. 19 has a checked pattern in which cross-shaped fractal grid structures are arrayed to define a closed, rectangularly shaped fractal pattern. Electrically conducting vias 1910 are positioned at a center and at corners of the periphery, or outmost sides, along an upper portion of the fractal radiation element 1900 as shown in FIG. 17.

Figure 20:
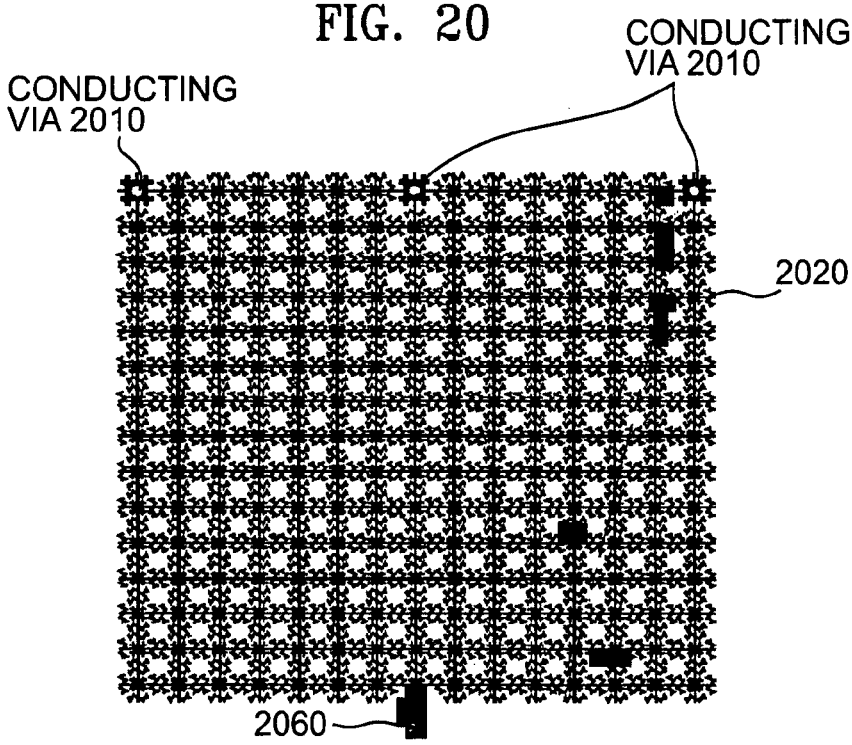

Fractal radiation element 2020 of FIG. 20 has a checked pattern in which herringbone-shaped or lightning-shaped and cross-shaped fractal grid structures are arrayed. The cross-shaped fractal grid structures are used for portions at which lines of the checked pattern meet, and the herringbone-shaped or lightning-shaped fractal grid structures are used for other portions. Alternatively, the herringbone-shaped or lightning-shaped fractal grid structures may be used for the portions of fractal radiation element 2020, and the cross-shaped fractal grid structures may be used for the other portions 2010. Positions of conducting vias 2010 are at a center and at the corners of an upper portion of the fractal radiation element 2000 as in FIG. 17.

Figure 21:
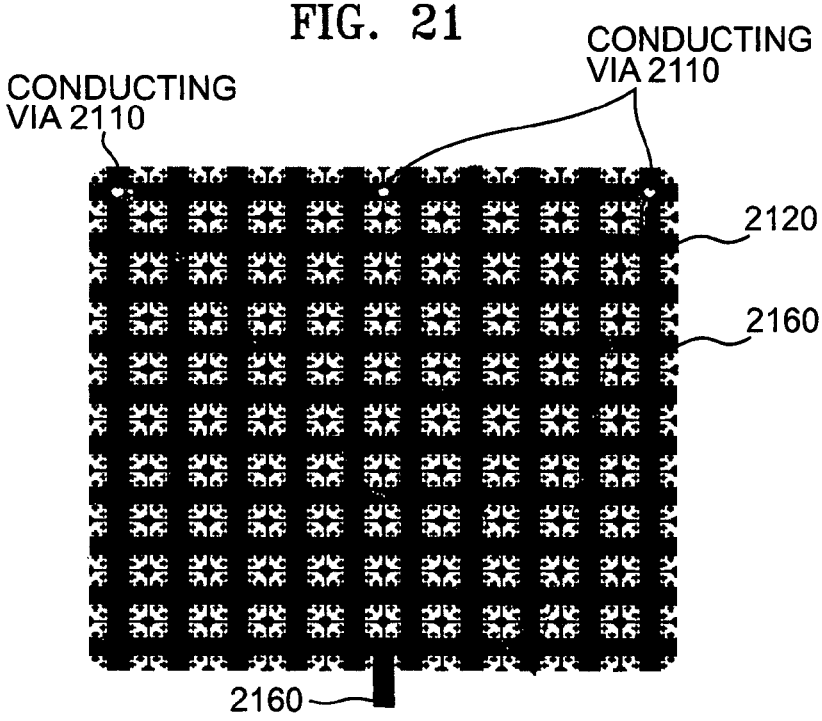

A fractal radiation element 2120 of FIG. 21 has a checked pattern in which cross-shaped fractal grid structures are arrayed. In other words, cross-shaped fractal grid structures are inserted into empty spaces of a center of the checked pattern in which fractal grid structures are not arrayed. Also, four direction faces of the cross-shaped inserted fractal structures are connected to spaces of the checked pattern in which fractal grid structures are arrayed. Conducting vias 2110 are positioned at a center and corners along the outermost sides of an upper portion of the pattern forming fractal radiation element 2120, along the outermost ring at the periphery of the fractal pattern of fractal radiation element 1900, longitudinally opposite from feed line 2060, as shown in FIG. 17. Conducting vias 2110 are effectively separated from feed line 2160 as far as possible; that is, conducting vias 2110 are separated from feed line 2160 by an approximation of the width of fractal pattern 2120.

Figure 22:
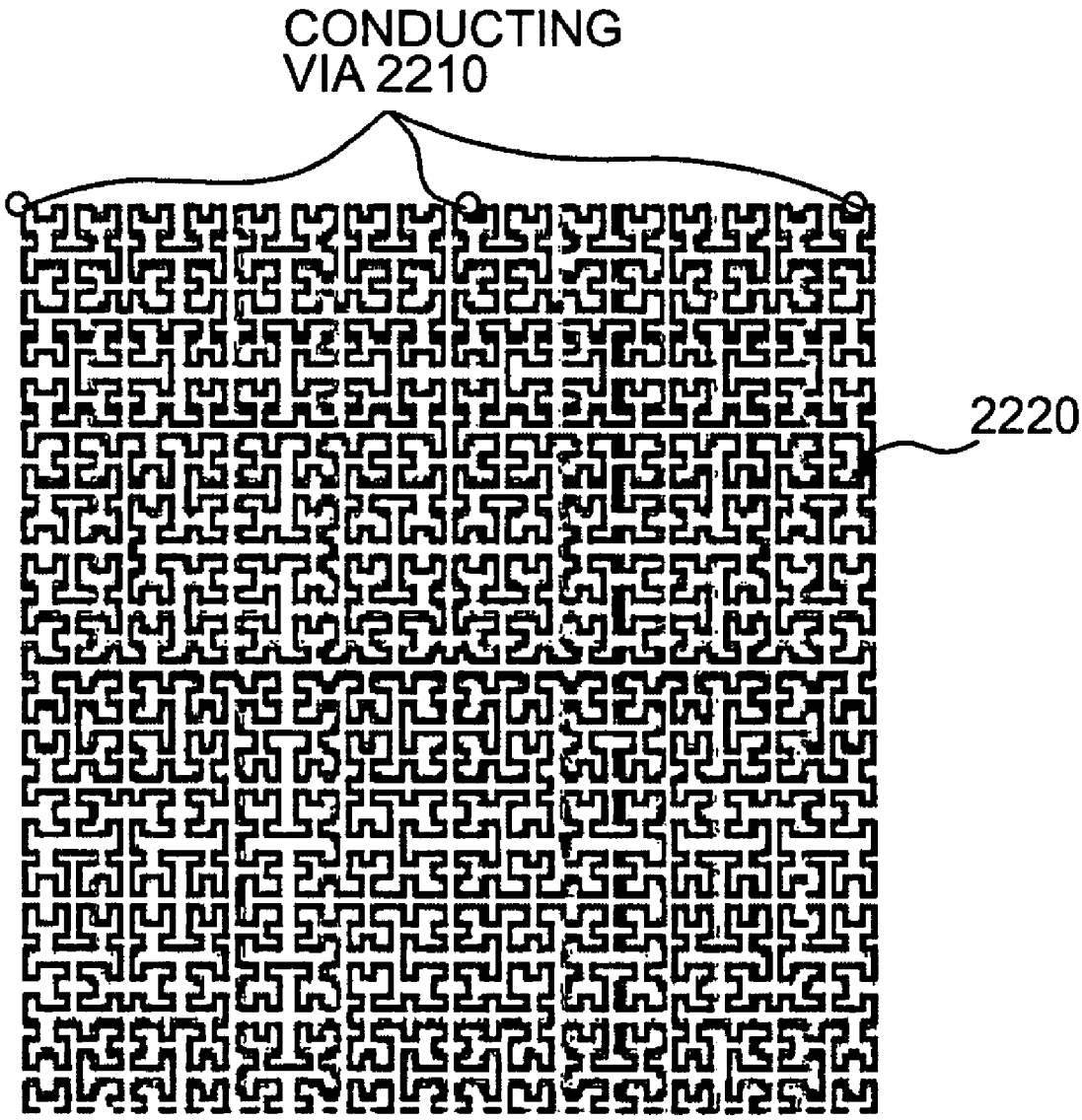

FIG. 22 illustrates a fractal radiation element 2220 having a Hilbert fractal grid structure. Conducting vias 2120 are positioned at a center and at the corners of an upper portion of the fractal radiation element as in FIG. 17, along the outer sides of fractal radiation element 2120, spaced diametrically or diagonally extreme positions from the junction formed between feed line 2060 and fractal radiating element 2020.

Figure 23:
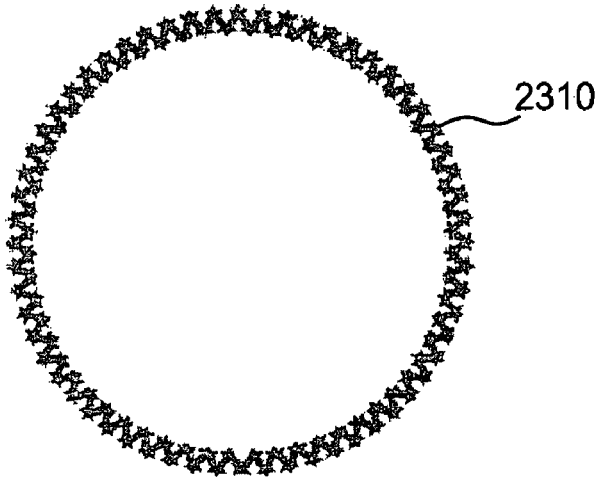
Figure 24:
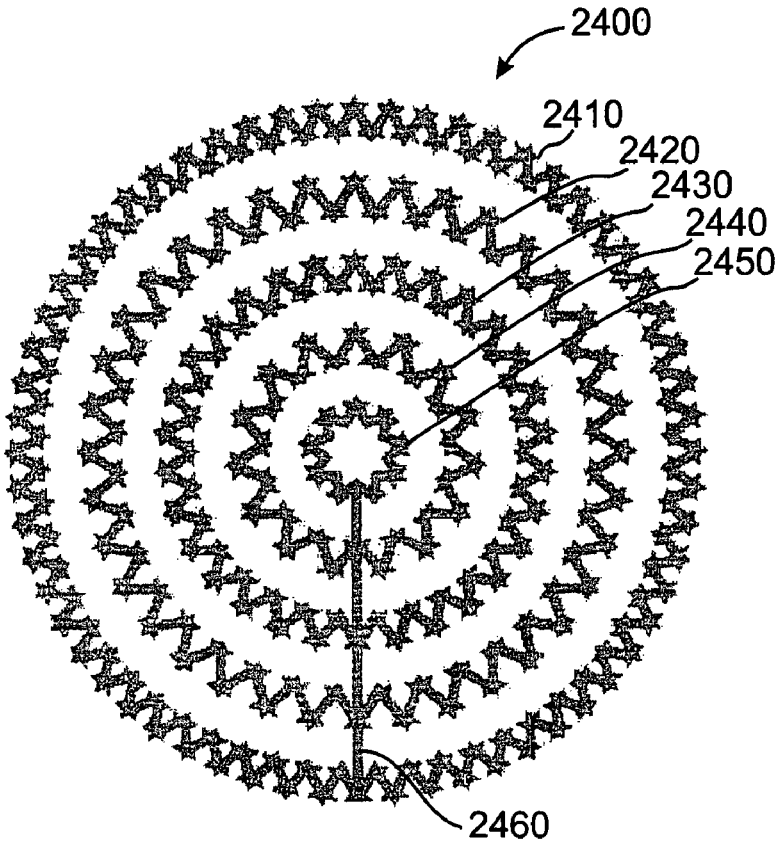

FIG. 23 illustrates a fractal radiation element 2310 having a circular shape in which inverted V-shaped fractal structures are repeatedly arrayed. FIG. 24 illustrates a fractal radiation element in which a predetermined number of inverted V-shaped fractal structures 2410, 2420, 2430, 2440 and 2450 having different sizes are coaxially arrayed in concentric circles electrically coupled to feed line 2460. Alternatively, an inverted V-shaped fractal structure may be dimensionally fractionized by a predetermined number of times and then repeatedly arrayed to form a circular shape.

The fractal radiation element of FIG. 24 includes five fractal radiation elements 2410, 2420, 2430, 2440 and 2450 in which inverted V-shapes that are dimensionally fractionized once are repeatedly arrayed in circular shapes. Feed line 2460 is electrically coupled to drive each of fractional radiation elements 2410, 2420, 2430, 2440 and 2450. Alternatively, to the fractal radiation element forming a closed loop, other embodiments of the fractal radiation element 2400 may be constructed with a side of each of the fractal radiation elements electrically opened.

Figure 25:
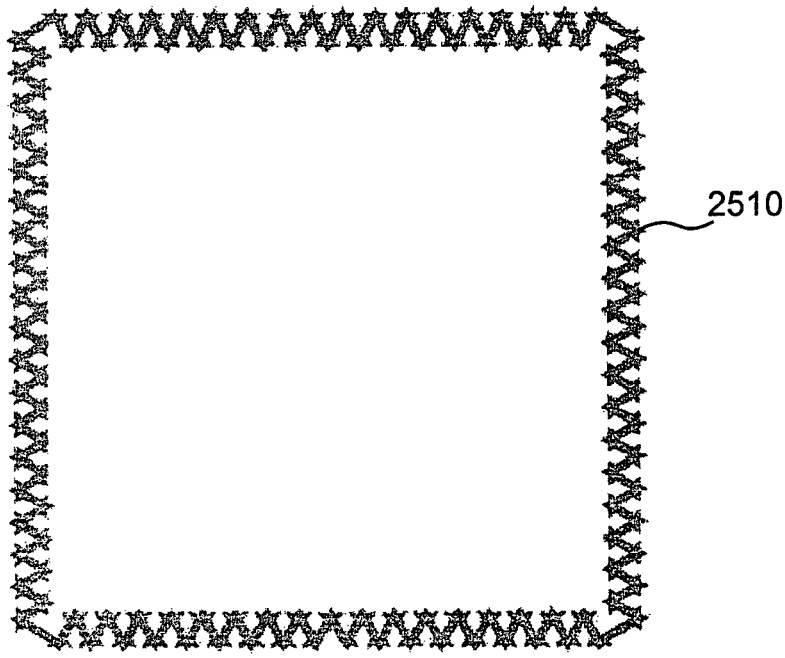
Figure 26:
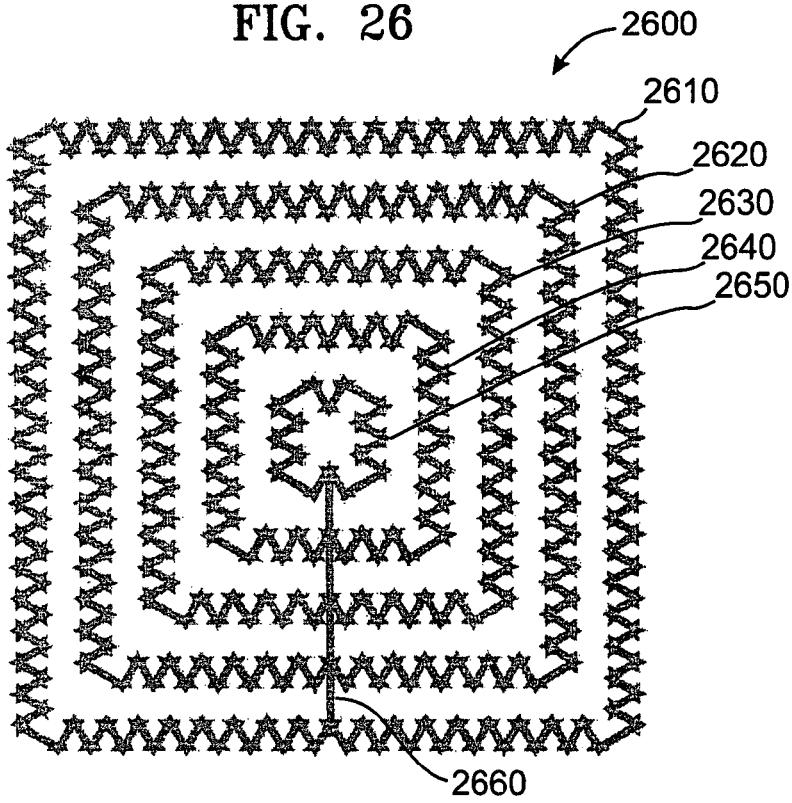

FIG. 25 illustrates a fractal radiation element 2510 having a square shape in which inverted V-shaped fractal structures are repeatedly arrayed. FIG. 26 illustrates five fractal radiation elements 2610, 2620, 2630, 2640 and 2650 having square shapes in which inverted V-shaped fractal structures that are dimensionally fractionized once are repeatedly arrayed as indicated by FIG. 24. Feed line 2660 is electrically coupled to drive each of fractional radiation elements 2610, 2620, 2630, 2640 and 2650.

Figure 27:
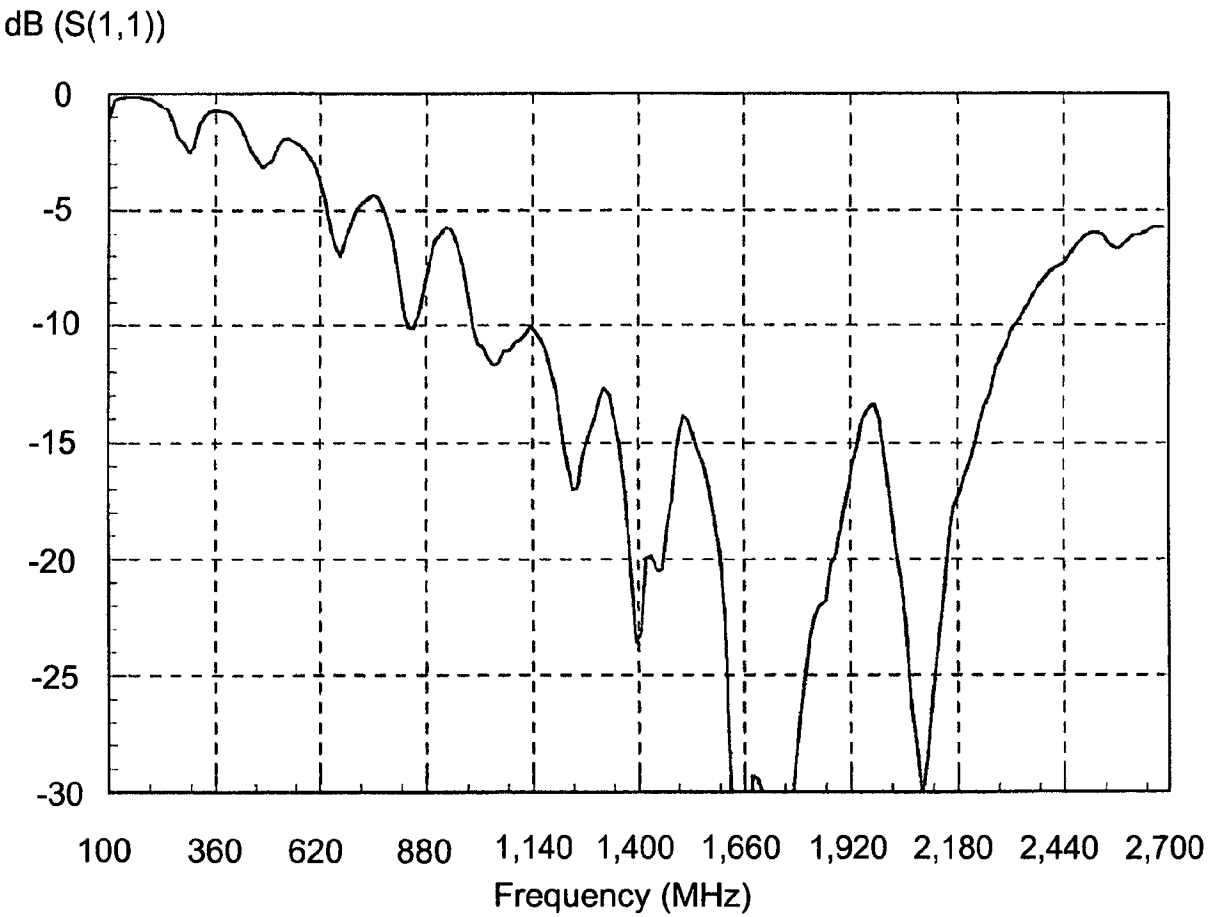
FIG. 27 is a two coordinate graph illustrating return loss in decibels as a function of frequency, for a multi-resonant broadband antenna representative of the principles of the present invention.

FIG. 27 is a graph illustrating return loss of a multi-resonant broadband antenna according to the present invention. Here, the return loss was measured in a frequency band between 100 MHz and 2700 MHz. As shown in FIG. 27, the return loss is improved through a broad frequency band.

As described above, a multi-resonant broadband antenna having a fractal structure can be realized through an array of a modification of a contemporary fractal structure antenna. Thus, a size of the multi-resonant broadband antenna can be maximized per unit area. As a result, radiation efficiency of the multi-resonant broadband antenna can be increased, and the multi-resonant broadband antenna can be made small with respect to a corresponding wavelength.

Various embodiments of a multi-resonant broadband antenna may be constructed according to the principles of the present invention with a dielectric substrate comprised of an upper surface bearing a fractal radiation element exhibiting a predetermined fractal grid structure adhered to an upper surface of a dielectric substrate, a feed line disposed along the upper surface of the dielectric substrate to feed the fractal radiation element, and a ground plane adhered to a lower surface of the dielectric substrate opposite from the feed line. A neighboring fractal parasitic radiation element oriented to re-radiate electromagnetic waves radiated from the fractal radiation element may be disposed on a position of the lower surface of the dielectric substrate opposite to and separated by the dielectric element from the fractal radiation element.

The fractal element, or plurality of fractal elements, which form the pattern of the fractal radiating element, or the pattern of the fractal parasitic radiating element, may be constructed as a closed loop that is symmetrically disposed around the feed line, in a coaxial array. In other embodiments, the pattern of the fractal radiating element, or the pattern of the fractal parasitic radiating element, may be constructed as an electrically open loop, as for example, with a proximal terminal of the radiating element electrically coupled to the feed line and the distal terminal of the radiating element physically, and electrically, open.

The multi-resonant broadband antenna may also be constructed with at least one additional fractal parasitic radiation element oriented to re-radiate electromagnetic waves radiated from the fractal radiation element, stacked upon the neighboring fractal parasitic radiation element on the lower surface of the dielectric substrate, in geometric alignment with the fractal radiation element.

At least one additional fractal parasitic radiation element oriented to re-radiate electromagnetic waves radiated from the fractal radiation element, may be stacked upon and in alignment with the fractal radiation element on the upper surface of the dielectric substrate.

In particular embodiments a multi-resonant broadband antenna may be constructed with at least one additional fractal parasitic radiation element employed to re-radiate electromagnetic waves radiated from the fractal radiation element, with the additional fractal parasitic radiation element stacked upon the fractal radiation element in geometric alignment with the fractal radiation element.

One or more electrically conducting vias may be formed between one of the fractal radiation element and the neighboring fractal parasitic radiation element, or formed between pairs of the additional fractal parasitic radiation elements. The conducting vias are disposed to electrically couple the outer peripheries of fractal patterns that are neighbors, and the vias are longitudinally separated by an approximation of the width of the fractal patterns so as to be separated to be as far as possible from the feed line. That is, a short circuit can be constituted so as to include a fractal radiation element, a fractal parasitic radiation element, and a conducting via formed between the fractal radiation element and the fractal parasitic radiation element. As a result, a broadband, high efficiency micro antenna can be realized.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A multi-resonant broadband antenna, comprising:

a dielectric substrate;

a fractal radiation element adhered on an upper surface of the dielectric substrate and having a predetermined fractal grid structure;

a feed line adhered on the upper surface of the dielectric substrate to feed the fractal radiation element;

a ground plane positioned on a lower surface of the dielectric substrate opposite to the feed line, and the ground plane being disposed at portions of the lower surface above which the fractal radiation elements are not geometrically projected; and a fractal parasitic radiation element disposed on a position of the lower surface of the dielectric substrate opposite to the fractal radiation element, the fractal parasitic radiation element being spaced apart and discrete from the ground plane and the fractal radiation element.

2. The multi-resonant broadband antenna of claim 1, comprising the fractal parasitic radiation element disposed to re-radiate electromagnetic waves radiated from the fractal radiation element.

3. The multi-resonant broadband antenna of claim 2, comprised of the dielectric substrate and at least one or more fractal parasitic radiation elements further stacked on one of the fractal radiation element or underneath the fractal parasitic radiation element.

4. The multi-resonant broadband antenna of claim 3, comprised of the fractal radiation element and the fractal parasitic radiation element have the same fractal structures.

5. The multi-resonant broadband antenna of claim 3, comprised of the fractal radiation element and the fractal parasitic radiation element have different fractal structures.

6. The multi-resonant broadband antenna of claim 2, comprising at least one or more electrically conducting vias formed between the fractal radiation element and the fractal parasitic radiation element.

7. The multi-resonant broadband antenna of claim 3, comprising at least one or more electrically conducting vias formed between the fractal parasitic radiation elements.

8. The multi-resonant broadband antenna of claim 7, comprised of the at least one or more electrically conducting vias being disposed at a point of an outermost periphery of a fractal pattern of the fractal radiation element, with the point being separated from the feed line with a farthest distance among all of points of the outermost periphery of the fractal pattern of the factual radiation element.

9. The multi-resonant broadband antenna of claim 6, comprised of the at least one or more electrically conducting vias being disposed at a point of an outermost periphery of a fractal pattern of the fractal radiation element, with the point being separated from the feed line with a farthest distance among all of points of the outermost periphery of the fractal pattern of the factual radiation element.

10. The multi-resonant broadband antenna of claim 2, comprised of the fractal radiation element and the fractal parasitic radiation element have the same fractal structures.

11. The multi-resonant broadband antenna of claim 2, comprised of the fractal radiation element and the fractal parasitic radiation element have different fractal structures.

12. The multi-resonant broadband antenna of claim 1, comprised of electrical conductors comprising a fractal structure comprised of at least one of a cross shape, a herringbone shape, a lightning shape, a Hilbert shape, and an inverted V shape disposed repeatedly to form an array forming the fractal radiation element.

13. The multi-resonant broadband antenna of claim 12, comprised of the fractal radiation element having a fractal grid structure comprising an array having at least one or more basic structures of one of an octagonal shape, a circular shape, and a square shape.

14. The multi-resonant broadband antenna of claim 13, with the fractal radiation element comprising a fractal grid structure having an open portion.

15. The multi-resonant broadband antenna of claim 13, comprised of "L"-shaped fractal grid structures added to corners of the octagonal shape of the fractal radiation element, and end portions of the "L"-shaped fractal grid structure are open or closed.

* * * * *